US007306255B2

(12) United States Patent
Walker et al.

(10) Patent No.: US 7,306,255 B2
(45) Date of Patent: Dec. 11, 2007

(54) BINDING SYSTEM

(75) Inventors: Ben Walker, Draper, UT (US); Jake Hall, Draper, UT (US); Brendan Perkins, Salt Lake City, UT (US); Paul Terry, Park City, UT (US); David Narajowski, Park City, UT (US); Thomas Laakso, Park City, UT (US); David Mellon, Park City, UT (US); Chad John Whittaker, Springville, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 194 days.

(21) Appl. No.: 11/271,072

(22) Filed: Nov. 12, 2005

(65) Prior Publication Data

US 2007/0108737 A1 May 17, 2007

(51) Int. Cl.
*A63C 9/00* (2006.01)
*A63C 9/084* (2006.01)
*A63C 9/085* (2006.01)

(52) U.S. Cl. ..... 280/614; 280/616; 280/617; 280/618; 280/623; 280/626; 280/631

(58) Field of Classification Search ..... 280/614, 280/616, 617, 618, 626, 623, 631
See application file for complete search history.

(56) References Cited

U.S. PATENT DOCUMENTS 4,029,336 A * 6/1977 Haimerl ..... 280/614
4,273,355 A * 6/1981 Storandt ..... 280/614
4,322,090 A * 3/1982 Loughney ..... 280/614
5,364,118 A * 11/1994 Burger et al. ..... 280/614
6,431,578 B2 * 8/2002 Pedersen et al. ..... 280/626

FOREIGN PATENT DOCUMENTS

DE 10064095 7/2002
EP 1509288 3/2005

* cited by examiner

*Primary Examiner*—Christopher P. Ellis
*Assistant Examiner*—John R. Olszewski
(74) *Attorney, Agent, or Firm*—Trent H. Baker; Baker & Associates PLLC

(57) ABSTRACT

The present invention relates to a ski binding that retains a boot to a ski in at least two independent operational states. One embodiment of a ski binding includes a toe receiving member and a releasable system. The toe receiving member is configured to engage the toe portion of the boot. The releasable system is configured to couple the toe receiving member to the ski in at least two independent operational states. A first state corresponds to a state in which the toe receiving member is allowed to freely rotate with respect to the ski. The first state is particularly useful in minimizing the necessary energy output for uphill travel. A second state corresponds to a state in which the toe receiving member is locked with respect to the ski. The second state is particularly useful in high performance downhill travel. The releasable system further includes an engagement mechanism and a switching mechanism. Additional states may also be included such as a third state in which both the toe receiving member and a heel portion of the boot are fixed with respect to the ski.

20 Claims, 8 Drawing Sheets

BINDING SYSTEM

FIELD OF THE INVENTION

The invention generally relates to binding systems. In particular, the invention relates to multi-state binding systems.

BACKGROUND OF THE INVENTION

A binding is used to couple or retain a user's foot to a particular object. Bindings are commonly used in athletic activities that incorporate an underfoot platform. These activities include skiing, snowboarding, surfing, wakeboarding, kiteboarding, skateboarding, etc. Various features and systems are incorporated into bindings depending on the particular activity for which they are primarily designed. These features may include states of operation, releasable responses, switching mechanisms, and various response characteristics. States of operation refer to a feature in which a binding may be configured to switch between different functions and/or states of operation that provide independent characteristics. For example, an Alpine Touring binding includes a free pivoting tour state and a restrained locked ski state. Releasable responses refer to various releasable mechanisms incorporated on a binding. For example, a releasable system may be incorporated on a ski binding to automatically disengage a boot from a ski in response to a particular force. Switching mechanisms refer to systems that switch or control the characteristics of a binding. For example, a switching device may be configured to enable a user to increase biasing forces or switch between states of operation. Response characteristics refer to any type of response or transfer of forces from a user's foot to the platform upon which it is bound.

Ski bindings in particular are designed to retain a user's boot to a ski in an optimal skiing position. The optimal position depends on the user and the particular subset of skiing in which they are engaged. Downhill skiing requires that a user's boot be retained to a ski at both the toe and heel. Whereas, Telemark and Cross-country skiing require only a portion of the boot to be coupled to the ski thereby allowing the boot to rotate or pivot with respect to the ski. Other activities such as Alpine Touring or Randonee skiing require a binding that can switch between two states of operation to accommodate both uphill and downhill travel. The uphill state must allow the boot to pivot with respect to the ski while the downhill state preferably retains the boot to the ski at both the toe and heel.

In addition to Alpine Touring, other types of skiing such as Telemark skiing may involve both uphill and downhill travel. The optimal binding characteristics for uphill and downhill travel are dramatically different from one another. Conventional Telemark bindings have generally compromised performance characteristics for uphill travel to provide an optimized binding for downhill travel. A few Telemark bindings have attempted to provide optimal characteristics for both uphill and downhill travel but include inefficient or cumbersome switching mechanisms. Therefore, there is a need in the industry for a skiing binding system that allows for optimal performance in multiple states of operation and includes an efficient and reliable switching mechanism for switching between the states.

SUMMARY OF THE INVENTION

The present invention relates to a ski binding that retains a boot to a ski in at least two independent operational states. One embodiment of a ski binding includes a toe receiving member and a releasable system. The toe receiving member is configured to engage the toe portion of the boot. The releasable system is configured to couple the toe receiving member to the ski in at least two independent operational states. A first state corresponds to a state in which the toe receiving member is allowed to freely rotate with respect to the ski. The first state is particularly useful in minimizing the necessary energy output for uphill travel. A second state corresponds to a state in which the toe receiving member is locked with respect to the ski. The second state is particularly useful in high performance downhill travel. The releasable system further includes an engagement mechanism and a switching mechanism. Additional states may also be included such as a third state in which both the toe receiving member and a heel portion of the boot are fixed with respect to the ski. In one embodiment, the releasable system is configured to engage the second locked state in the event of any form of operational failure including failures resulting from damage to the releasable system or decoupling between the switching mechanism and the engagement mechanism. In a second embodiment, the engagement system includes an under-boot rotatable latching mechanism. In a third embodiment, the switching mechanism is configured to switch between the first and second states in response to a similarly aligned force. In a third embodiment, the binding includes a replaceable flex system that provides a biasing force against the boot as it pivots away from the ski in the second state. In a fourth embodiment, the binding includes a climbing rotation point about which the toe receiving member is free to rotate with respect to the ski in the first state, and a pivot point about which a heel portion of the boot is allowed to pivot with respect to the ski in the second state.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE INVENTION

Figure 1:
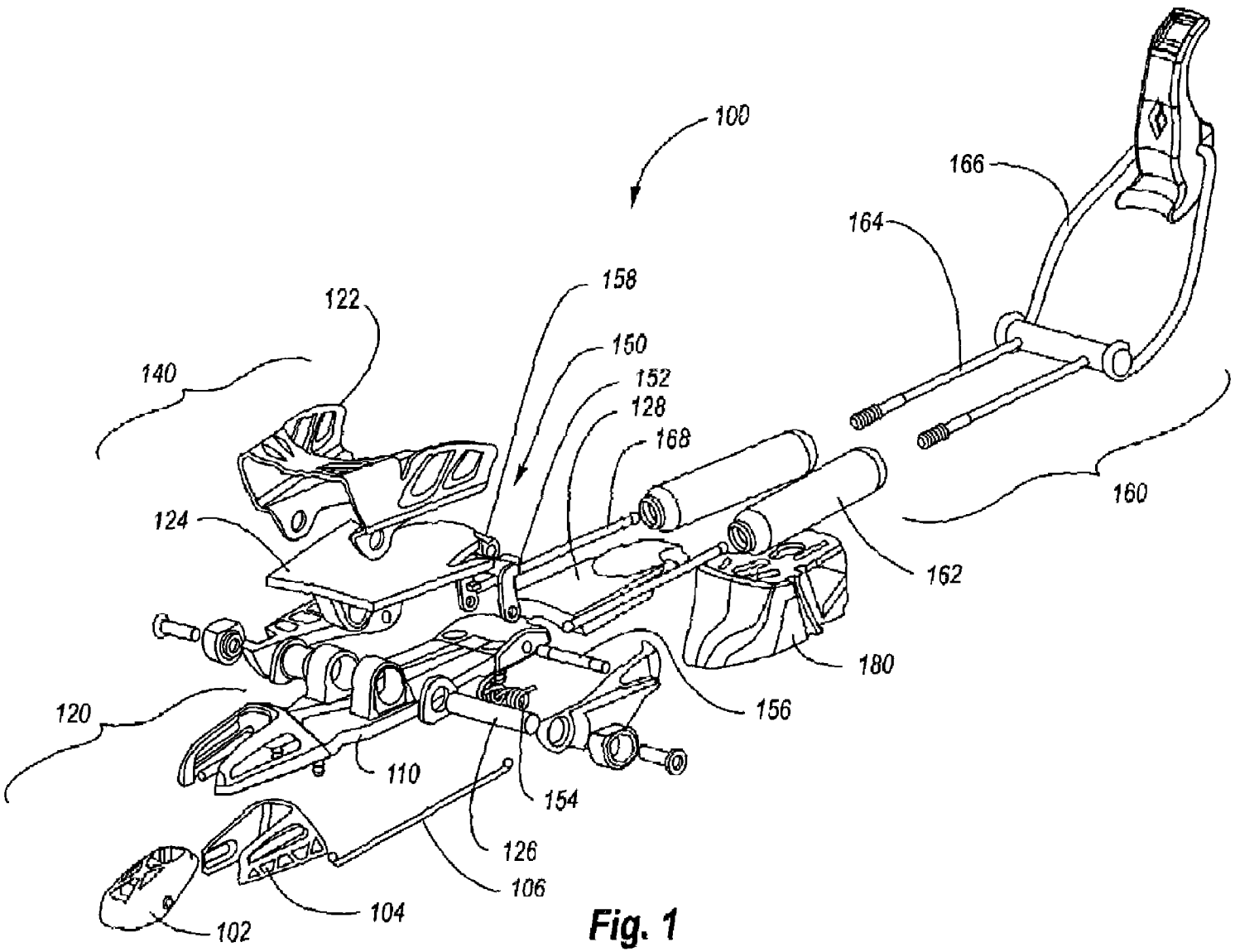
FIG. 1 illustrates an exploded view of one embodiment of a binding in accordance with the present invention including a toe receiving member and a releasable system.
Figure 2:
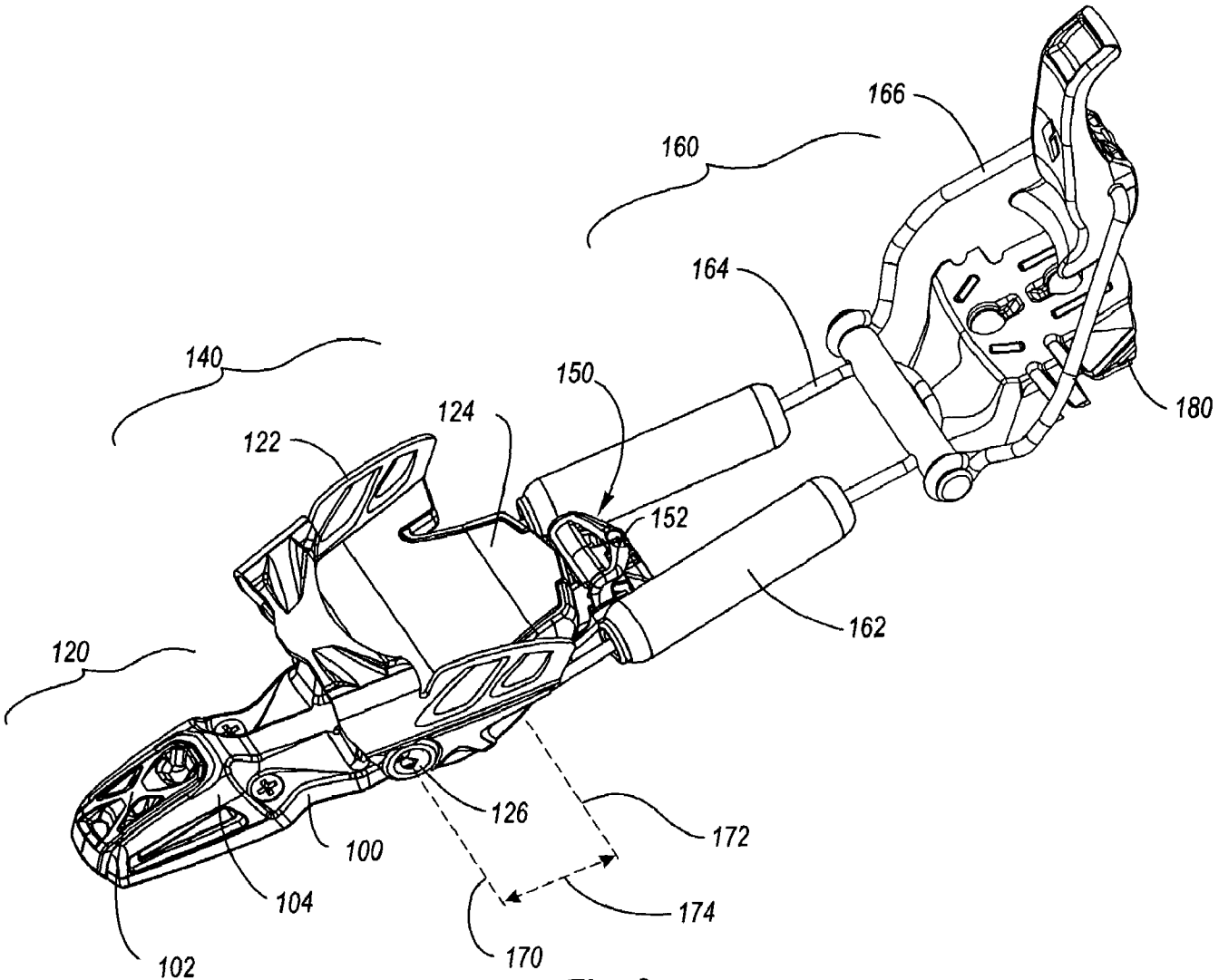
FIG. 2 illustrates a perspective view of the binding of FIG. 1 in a locked operational state in which the toe receiving member is fixed to the base.

The present invention relates to a ski binding that retains a boot to a ski in at least two independent operational states. One embodiment of a ski binding includes a toe receiving member and a releasable system. The toe receiving member is configured to engage the toe portion of the boot. The releasable system is configured to couple the toe receiving member to the ski in at least two independent operational states. A first state corresponds to a state in which the toe receiving member is allowed to freely rotate with respect to the ski. The first state is particularly useful in minimizing the necessary energy output for uphill travel. A second state corresponds to a state in which the toe receiving member is locked with respect to the ski. The second state is particularly useful in high performance downhill travel. The releasable system further includes an engagement mechanism and a switching mechanism. Additional states may also be included such as a third state in which both the toe receiving member and a heel portion of the boot are fixed with respect to the ski. In one embodiment, the releasable system is configured to engage the second locked state in the event of any form of operational failure including failures resulting from damage to the releasable system or decoupling between the switching mechanism and the engagement mechanism. In a second embodiment, the engagement system includes an under-boot rotatable latching mechanism. In a third embodiment, the switching mechanism is configured to switch between the first and second states in response to a similarly aligned force. In a third embodiment, the binding includes a replaceable flex system that provides a biasing force against the boot as it pivots away from the ski in the second state. In a fourth embodiment, the binding includes a climbing rotation point about which the toe receiving member is free to rotate with respect to the ski in the first state, and a pivot point about which a heel portion of the boot is allowed to pivot with respect to the ski in the second state. Also, while embodiments of the present invention are directed at ski bindings, it will be appreciated that the teachings of the present invention could be applied to other areas.

The following terms are defined as follows:

Under boot—an elevational position located below the surface of the boot. For example, a cable that runs under the sole of the boot is an under-boot cable. A particular lateral position is considered under-boot if it is below the boot at that particular lateral position. Therefore, if the heel portion of the boot is substantially lower than the remainder of the boot, a device disposed below the toe portion of the boot but above or in line with a heel portion of the boot may still be considered under-boot.

Toe portion of a boot—the region of the boot in front of the location at which the ball of a users foot is disposed. For example, the toe portion of a ski boot would include the duckbill, a toe portion of the sole, and a toe portion of the upper casing.

Hand replaceable—an item is hand replaceable if it can reasonably be replaced without the use of additional tools.

Rotation point—a point about which a boot is able to rotate with respect to the ski with little or no resistance.

Pivot point—a point about which a boot is able to pivot with respect to the ski against a biasing force. A pivoting motion includes the ability to raise the heel portion of a boot with respect to the ski while the toe portion of the boot remains fixed or substantially fixed to the ski.

Pin line—a standardized boot location corresponding to a particular distance in front of the toe region of the boot. On Telemark 3-pin boots, the pin line is the lengthwise ski location of connection between the boot and the binding.

Front of the boot—a lateral location corresponding to the forward most portion of a boot; on most ski boots this position is the front portion of the duckbill. However, on non-duckbill boots, the front of the boot may be located closer to the toe box.

75 mm boot—a boot that complies with the international Telemark boot standard of requiring a 75 mm duckbill toe portion.

Independent operational states—states in which a boot is coupled to a ski so as to provide independent performance characteristics. For example, a tour/free state refers to an operational state in which a boot is able to rotate with respect to the ski with a minimal amount of frictional resistance. Likewise, a skiing/locked state refers to an independent operational state in which at least a portion of a boot is fixed with respect to the ski.

Reference is initially made to FIG. 1, which illustrates an exploded view of one embodiment of a binding in accordance with the present invention including a toe receiving member 140 and a releasable system, designated generally at 100. The illustrated binding 100 includes a base 110, a toe receiving member 140, a heel attachment system 160, and a releasable system (120, 150). These components operate together to provide a binding 100, which is capable of engaging multiple independent operational states. An operational state is a particular configuration that can be used by a user to configure the binding 100 to particular performance characteristics. The releasable system further includes a switching mechanism 120 and an engagement mechanism 150 to facilitate switching between and engaging the particular operational states. The base 110 is an elongated member fixably coupled directly to a ski (not shown). The base 110 provides a platform upon which the other components are configured to operate. In addition, an optional heel base 180 is included to provide a platform for the heel portion of a boot that is substantially the same height as the toe receiving member's 140 boot supporting surface. Likewise, a base cover 128 is included to protect a portion of the base 110 from debris.

The toe receiving member 140 is configured to receive and engage a toe portion of a boot (not shown). Boots are configured in a variety of standardized shapes depending on their particular application including the Telemark 75 mm boot standard. The illustrated toe receiving member 140 is configured to match the 75 mm boot standard meaning that it is compatible with the majority of existing Telemark boots. However, the teachings of the present invention are consistent with alternatively shaped toe receiving members that are capable of accommodating other boot standards. The toe receiving member 140 is shaped to releasably engage the toe portion of a boot by matching the shape and allowing the duckbill portion of the boot to slide under a crossbar member.

The toe receiving member 140 further includes a toe housing 122, a toe base 124, and a rotation axle 126. As described above, the toe housing 122 and toe base 124 are shaped to encircle the toe portion of a boot in a manner to releasably engage the boot. The boot is forced forward by the heel attachment system 160 therein coupling the boot to the binding 100. The toe housing 122 includes two side members and a crossbar that engages a top portion of the duckbill of a boot. Alternative designs may incorporate flanges or smaller crossbar members that are designed to couple with boots that do not contain a 75 mm duckbill. The toe receiving member 140 is coupled to the base 110 via the rotation axle 126. The rotation axle 126 allows the toe housing 122 and the toe base 124 to pivot with respect to the base. The toe base 124 further includes a latch receiving member 158 which is part of the engagement mechanism 150. As will be described in more detail below, when the engagement mechanism is engaged with the toe base 124, the toe receiving member is restricted from rotating about the rotation axle 126.

The toe receiving member 140 is coupled to the heel attachment system 160 via the front cables 168. The attachment between the toe receiving member 140 and the heel attachment system 160 is accomplished at an under-boot location. Therefore, when the toe receiving member 140 is restricted from rotating with respect to the base 110, the heel attachment system 160 will be able to pivot about a particular cable exit location on the toe receiving member 140. It is important to note that the location of the cable exit location is different from the rotation axle 126. The location of the cable exit location/pivot point will be described in more detail in the paragraphs below.

The switching mechanism 120 is part of the releasable system that allows the binding 100 to switch between the independent operational states. The switching mechanism 120 is disposed at a frontal under-boot location with respect to the toe receiving member 140. The frontal location allows a user to easily switch between operational states without reaching behind the binding 100. This also provides a user with a convenient visual indicator corresponding to which operational state the binding is currently engaged in. The switching mechanism 120 generally includes a toggle member 102, a switch housing 104, and a switch cable 106. The switch housing 104 is fixably coupled to the base 110 and includes an enclosed channel recess on either side. The toggle member 102 includes two protrusions that extend into the enclosed channel recesses of the switch housing 103. The toggle member 102 is shaped to pivot about two positions as the protrusions slide along the enclosed channel recess. Therefore, the toggle member 102 acts as a dual position toggle pivot switch within the switch housing 104. The switch cable 106 is coupled to an underside of the toggle member 102 such that it is extended or retracted a particular translational distance as the toggle member 102 pivots within the switch housing 104. The pivoting motion of the toggle member 102 with respect to the switch housing 104 allows the switching mechanism 120 to be switched between the operational states with substantially the same directional force. In the illustrated embodiment, this switching force is a downward pushing force but other configurations could be designed such that the switching force is an elevational pulling force, a translational force, or some other similarly aligned force. From a user convenience and efficiency standpoint, it is advantageous to provide a switching mechanism in which the force required to switch between the operational states is directionally aligned.

The engagement mechanism 150 is also part of the releasable system that operates with the switching mechanism 120 to allow the binding 100 to switch between the operational states. The engagement mechanism 150 is located at a rear under-boot location with respect to the toe receiving member 120. The engagement mechanism 150 is configured to releasably secure the toe receiving member 120 to the base 110 in a fixed operational state. In a free rotation state, the engagement mechanism is configured to allow the toe receiving member 120 to rotate without interference so as to minimize frictional forces upon the toe receiving member 120 as it rotates with respect to the base 110. The engagement mechanism 150 is coupled to the switching mechanism 120 via the switch cable 106. The engagement mechanism 150 includes a latch 152, a latch receiving member 158, a latch axle 156, and a latch spring 154. The latch 152 is configured to rotationally hook onto the latch receiving member 158. The latch receiving member 158 is disposed on the toe base 124 and the latch 152 is coupled to the base 110. Therefore, when the latch 152 hooks onto the latch receiving member 158, toe receiving member 120 is prevented from rotating about the rotation axle 126. As illustrated, the latch 152 rotates about a latch axle 156 in a direction substantially parallel to the longest dimension of the base 110 and ski (not shown).

The latch 152 is spring biased into an engaged or hooked position by the latch spring 154. The latch spring 154 is coupled to both the latch 152 and base in a manner to provide the bias of the latch 152 towards the engaged position. The switch cable 106 is routed below and around the base 110 in a manner to provide a constant downward pulling force on the latch 152 when the switch is configured to engage the free rotation operational state. A swage/chocking system may be used to couple the switch cable 106 to the latch 152.

The heel attachment system 160 is coupled to the toe receiving member 140 to releasably retain the heel portion of a boot. The heel attachment system 160 is configured to exert a retention force upon the boot which forces the toe portion of the boot 140 forward effectively engaging the toe receiving member 140. In addition, the heel attachment system 160 extends primarily under the boot of a user. The heel attachment system 160 further includes a pair of front cables 168, a pair of spring cartridges 162, a rear cable 164, and a heel throw 166. The heel attachment system 160 also acts as a biasing system that exerts a biasing force upon a heel portion of the boot as it pivots independently of the toe portion of the boot. Therefore, if the toe portion of the boot is fixed (ie. the toe receiving member 140 is locked with respect to the base 110), the heel is allowed to pivot upward against the biasing force generated by the heel attachment system 160. The spring cartridges 162 act as the biasing elements that generate the biasing force against the heel portion of the boot. The spring cartridges 162 also exert the retention force to secure the boot into the toe receiving member 140. The spring cartridges 162 include a spring and a cover and may be configured to adjust the amount of force they exert. The inclusion of two spring cartridges 162/biasing elements is advantageous in providing consistent biasing forces upon the boot during lateral movements. The spring cartridges 162 may also be adjustable so as to increase or decrease the amount of biasing force they generate. One type of adjustment system allows for a simple rotation of the cartridge to effectuate the increase or decrease of spring tension depending on the direction or rotation. The spring cartridges 162 may further include releasable coupling mechanisms for attachment to the front cables 168 and the rear cables 164. These releasable mechanisms allow for the convenient replacement of the spring cartridges 162. A cable swage/chocking system may again be used to provide this releasable coupling mechanism between the spring cartridges 162 and the cables 168, 164. The replacement system described above allows the spring cartridges 162 to be reasonably replaceable as opposed to requiring extensive tooling and/or dismemberment. In addition, the spring cartridges 162 can be designed to be hand replaceable.

The front cables 168 are coupled to the toe receiving member 140 in a manner that allows them to be hand releasable. For example a swage/chocking system can be used such that when the front cables 168 are not under tension, they can easily be unchocked and disengaged from the toe receiving member 140. Naturally, various other coupling systems can be used between the front cables 168 and the toe receiving member 140 and remain consistent with the present invention. The front cables 168 are releasably coupled to the spring cartridges 162.

The rear cable 164 and the heel throw 166 operate to couple the heel attachment system 160 to the heel portion of a boot. Almost all boots contain a ledge or protrusion which is commonly used to attach various boot accessories such as a binding. The heel throw 166 is shaped and configured to hook over a rear protrusion on the boot and allow a user to generate a particular amount of separational force via a lever motion. The generated separational force provides the necessary force to overcome the spring cartridges' retention forces and thereby couple the heel attachment system 160 to the boot. Likewise, the illustrated heel attachment system 160 provides a mechanism for releasing the boot from the binding 100 if particular forces are imposed. It is beneficial to allow a boot to release from a binding so as to prevent or minimize injury to a user.

Reference is next made to FIGS. 2, 4, 5, and 7, which illustrate various views of the binding of FIG. 1 in a locked operational state in which the toe receiving member is fixed to the base. The locked operational state refers to a state in which the toe receiving member 140 is fixed and/or prevented from rotating with respect to the base 110 and ski. The locked operational state may also be referred to as a ski state, a locked state, a downhill state, a fixed state, or a Telemark state. By locking the toe receiving member 140 to the base 110, the toe portion of a boot is also locked to the base 110. However, many boots are designed to articulate or pivot in a manner similar to how a user's foot articulates. It is a natural movement for a user's toe and ball region to remain flush with a surface while the heel is lifted. The locked state is designed to mimic this natural motion. The heel portion of the boot is allowed to pivot with respect to the ski about a particular pivot point 172, which substantially corresponds to the ball of a user's foot. The location of the pivot point 172 is extremely important for skiing performance.

Telemark skiing by definition involves pivoting a boot with respect to the ski. Using this pivoting to turn a ski in the snow is often referred to as a "Telemark turn". For downhill skiing purposes, it is desirable to position the pivot point 172 as close to the ball of a user's foot as possible. Conventional Telemark bindings were forced to balance the benefits of an under ball pivot with the inefficiencies it may produce for uphill travel. Since the binding described herein is a multi-operational state binding, a separate state is dedicated to uphill travel and it is not necessary to compromise the location of the pivot point 172. Therefore, the pivot point 172 is disposed away from the rotation point 170 by at least 30 mm as designated by 174. In addition, the pivot point 172 is disposed away from the front of a boot by at least 24 mm. And further, the pivot point 172 is disposed away from the pin line by at least 10 mm.

In operation, the locked state is engaged by a series of interconnected operations. The specific interrelation of the various components is best illustrated in the cross-sectional view illustrated in FIG. 7. The locked state is accomplished by selecting the locked state on the switching mechanism via a downward pushing force in the illustrated embodiment. The switching mechanism is particularly configured to accept the downward force via a ski pole. The locked configuration corresponds to the toggle member 102 being flush with the switch housing 104, as shown. The locked configuration of the switching mechanism extends or releases tension in the switch cable 106 to the engagement mechanism 150. Since the latch 152 is spring biased into the engaged position, the extension of the switch cable 106 allows the latch 152 to hook over the latch receiving member 158 of the toe receiving member 140. It should be noted that if the toe receiving member 140 is rotated up when switching is executed, it will be necessary to compress the toe receiving member 140 toward the base 110. This compression will forcibly slide the latch receiving member 158 under the latch 152 causing engagement. This may also be referred to as a step-in engagement of the locked state.

Figure 4:
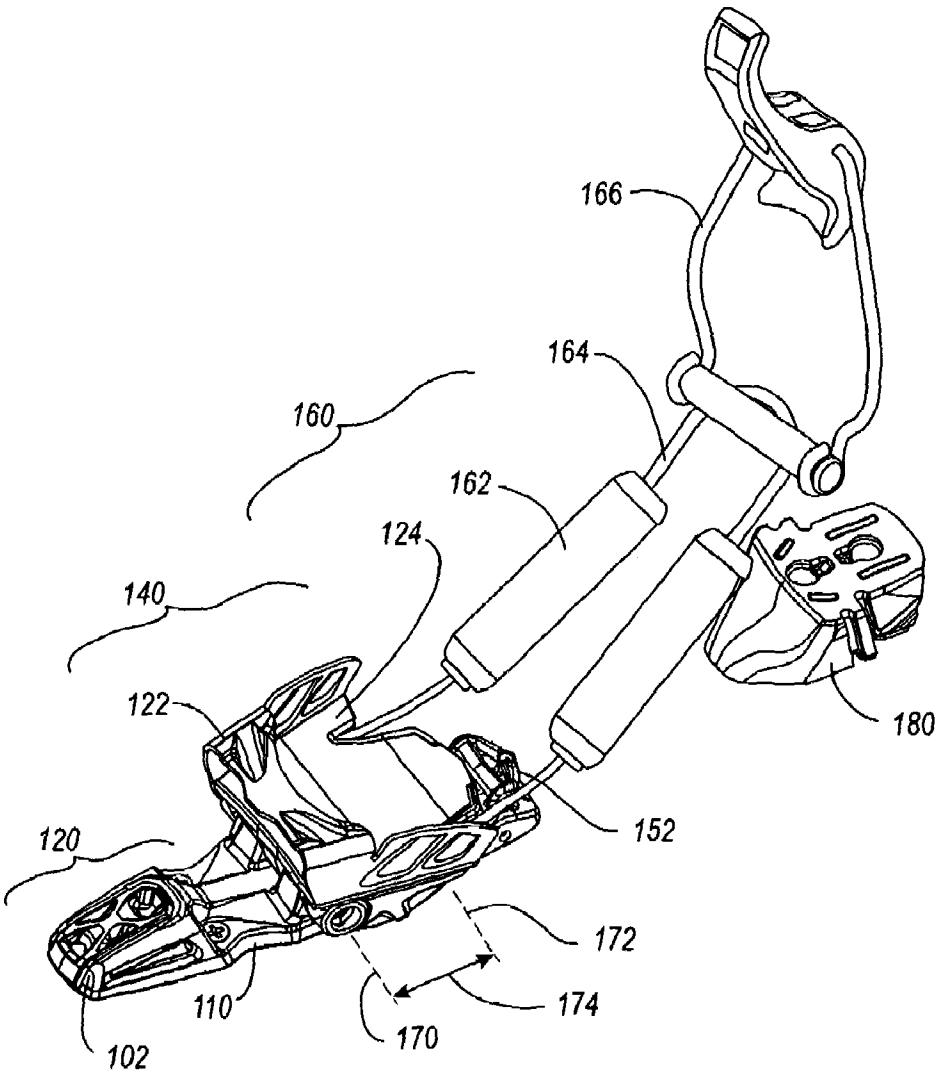
FIG. 4 illustrates a perspective view of the binding of FIG. 1 in a locked operational state in which the toe receiving member is fixed to the base, and wherein the heel attachment system is shown in a pivoted position corresponding to how a user's boot would be able to pivot in the locked state even though the toe receiving member is locked with respect to the base.
Figure 5:
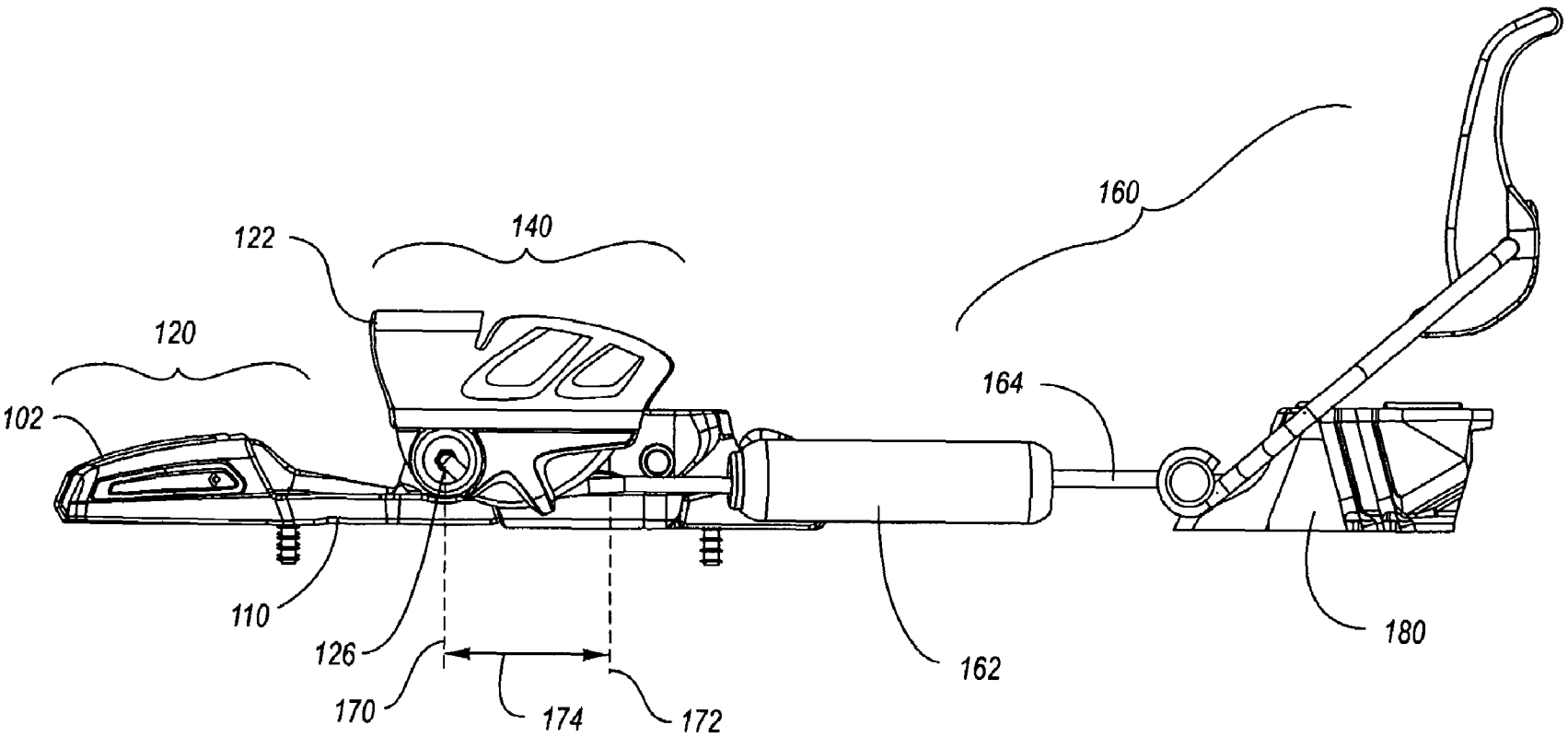
FIG. 5 illustrates a profile view of the binding of FIG. 1 in a locked operational state in which the toe receiving member is fixed to the base.

FIG. 4 illustrates how the heel attachment system 160 is able to pivot about the toe receiving member 140 in the locked state. Since the heel attachment system 160 is coupled to the toe receiving member 140 via the front cables 168, the articulation point of the front cables 168 is in effect the pivot point 172. The toe receiving member 140 has been specifically designed to position the pivot point 172 about a location consistent with optimal downhill Telemark performance. This location is often referred to as a "high performance pivot" in the industry. As the heel portion of the boot pivots, a biasing force is exerted by the biasing system contained in the heel attachment system 160. Pivoting causes a particular under-boot distance between the heel of a boot and the toe portion to increase, therein requiring an elongation of the spring cartridges 162. Naturally, the further a boot is pivoted away from the ski, the more biasing force will be exerted. In addition, the dual spring cartridges have the ability to exert different biasing forces on the boot if the boot is rotated or articulated to the side in some manner.

Figure 3:
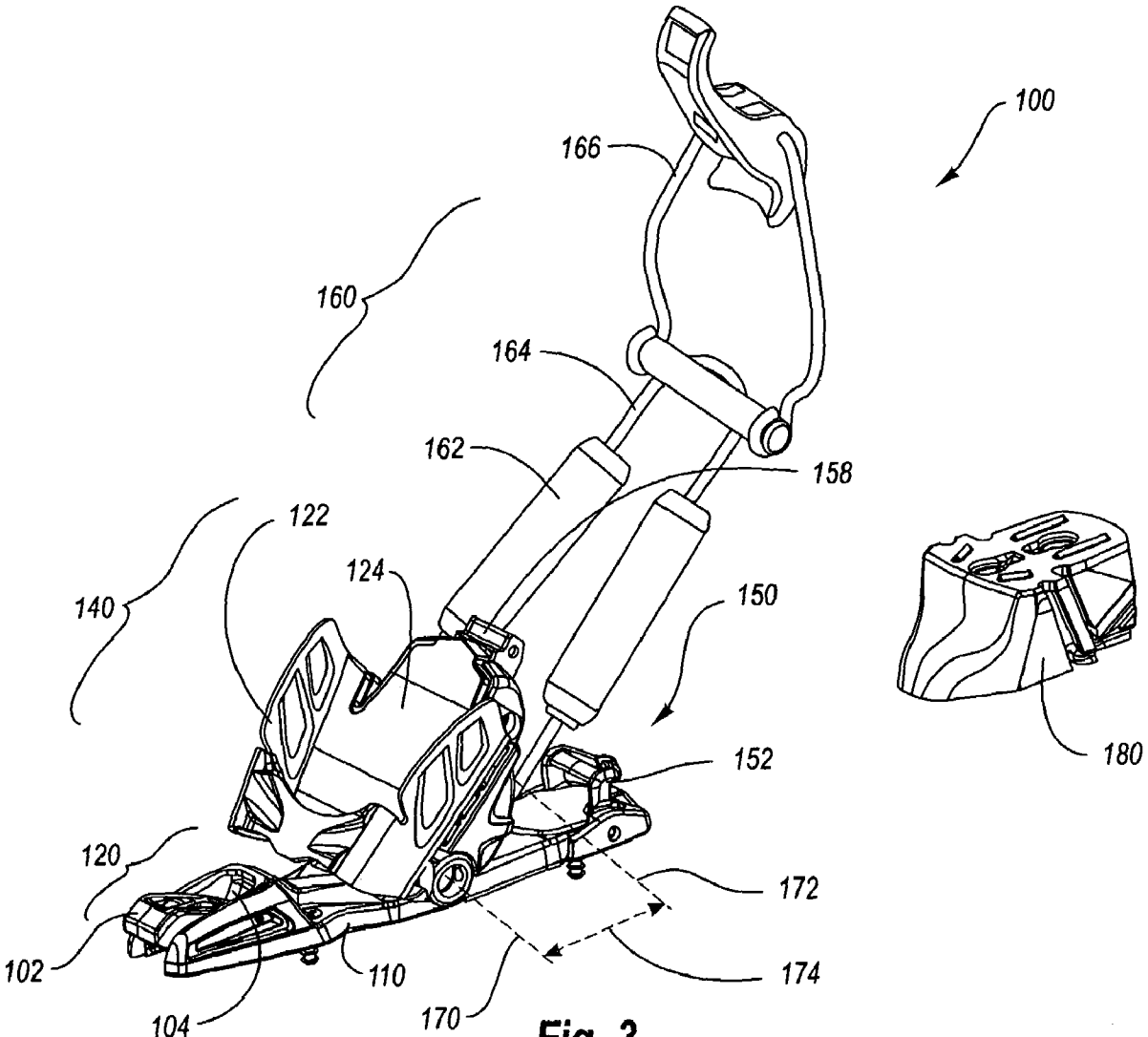
FIG. 3 illustrates a perspective view of the binding of FIG. 1 in a free rotation operational state in which the toe receiving member is free to rotate with respect to the base.
Figure 6:
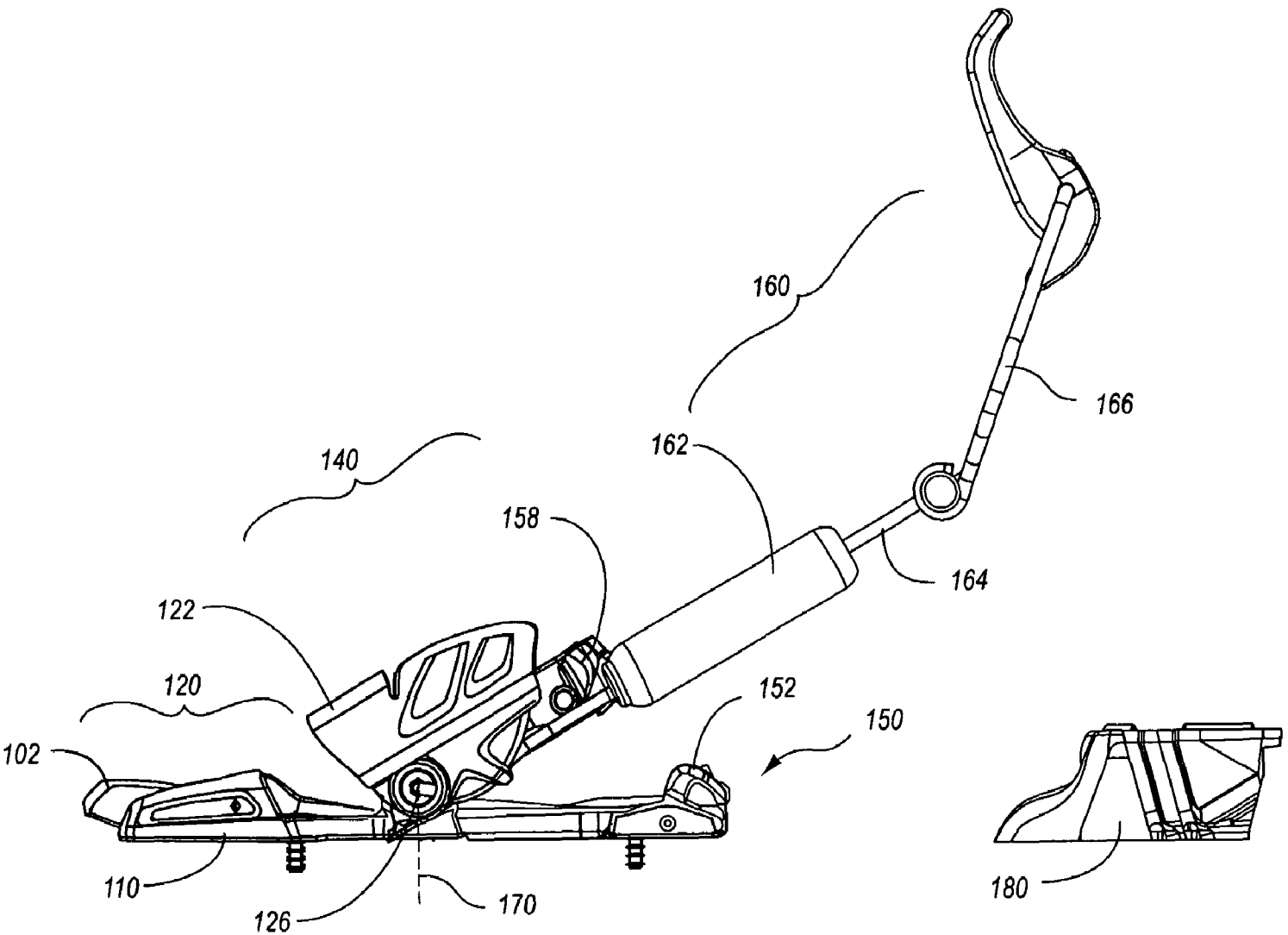
FIG. 6 illustrates a profile view of the binding of FIG. 1 in a free rotation operational state in which the toe receiving member is free to rotate with respect to the base.
Figure 7:
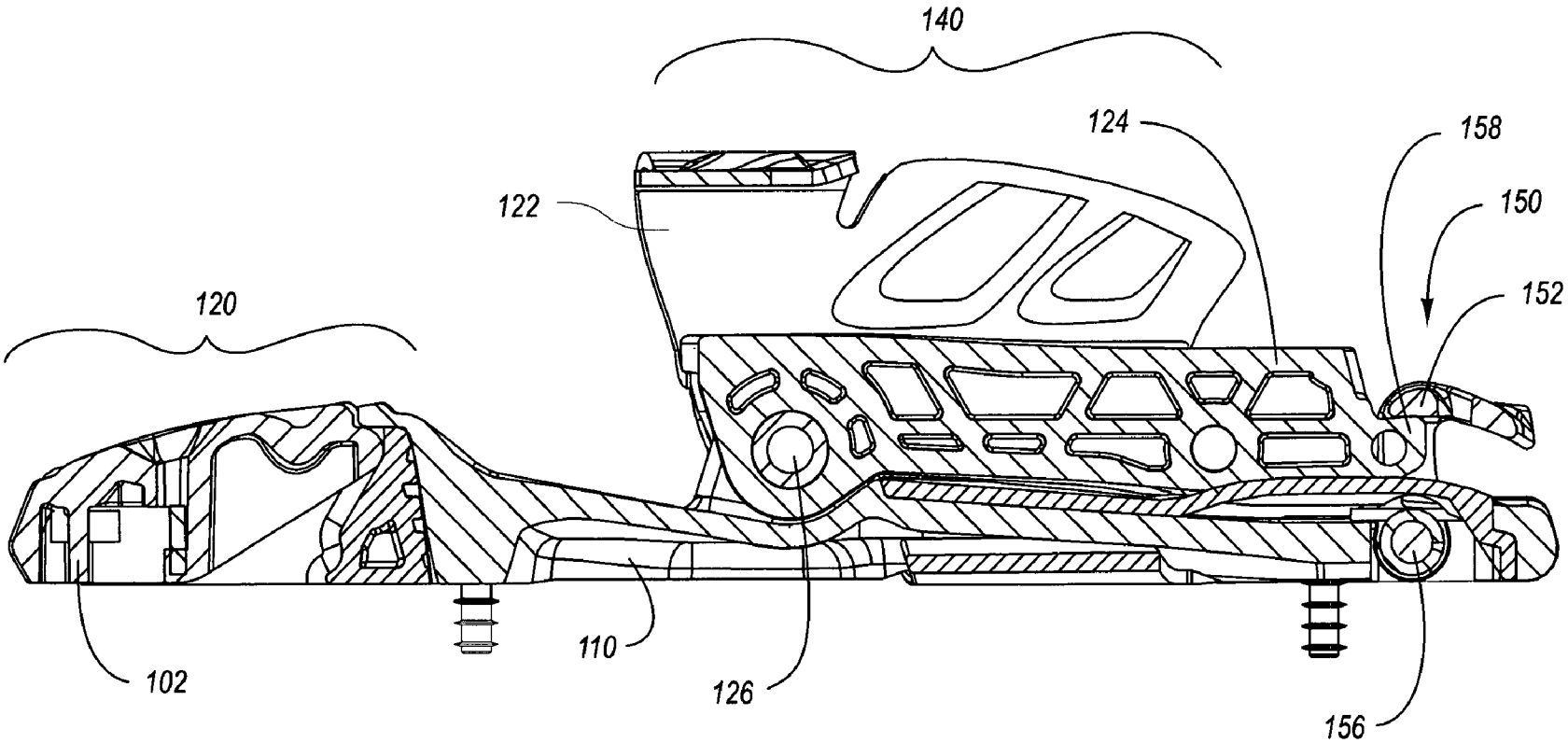
FIG. 7 illustrates a lengthwise medial cross-sectional view of the toe receiving member of FIG. 1 in a locked operational state in which the toe receiving member is fixed to the base.
Figure 8:
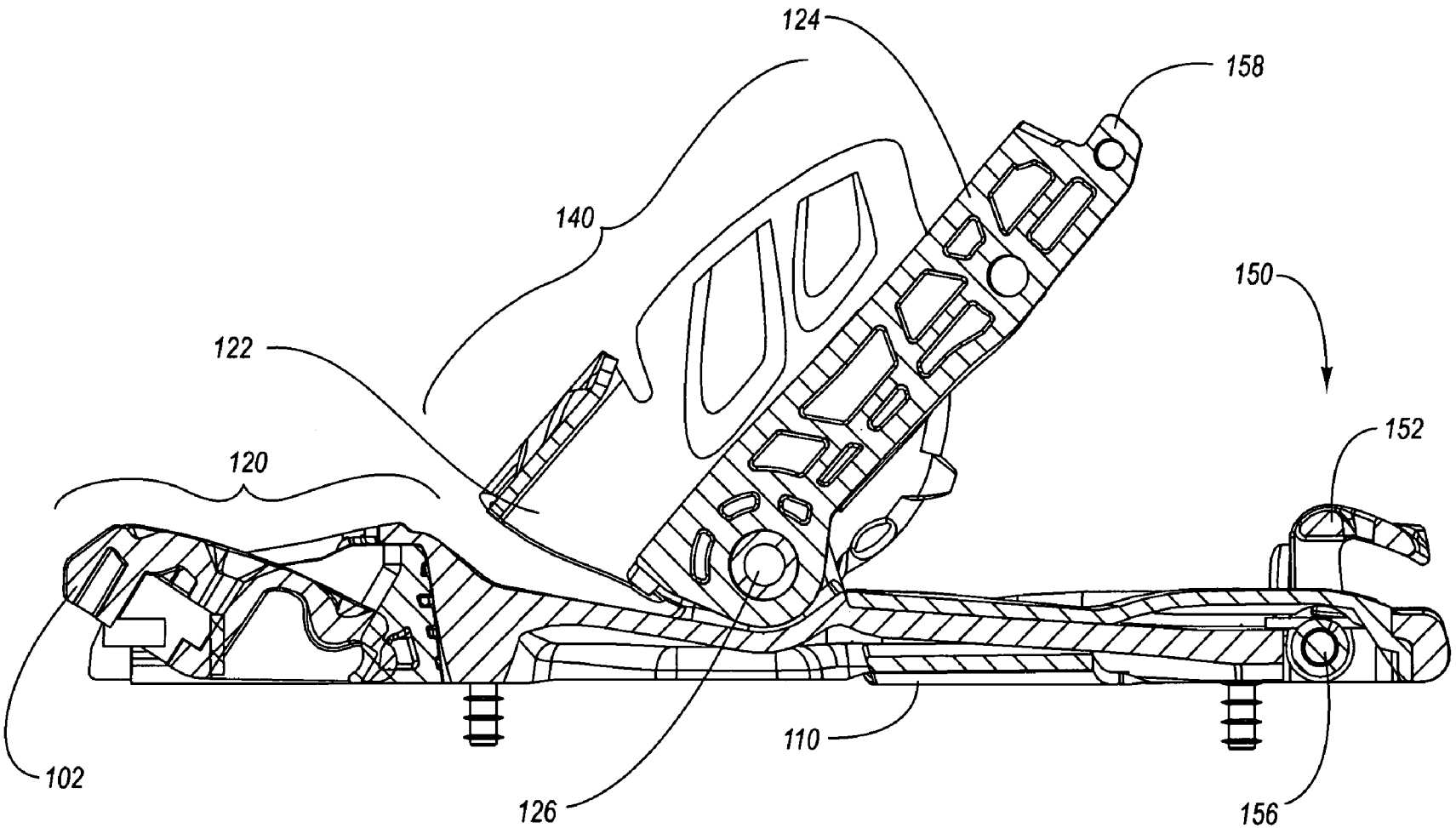
FIG. 8 illustrates a lengthwise medial cross-sectional view of the toe receiving member of FIG. 1 in a free rotation operational state in which the toe receiving member is free to rotate with respect to the base.

Reference is next made to FIGS. 3, 6, and 8, which illustrate various views of the binding of FIG. 1 in a free rotation operational state in which the toe receiving member is free to rotate with respect to the base. The free rotation operational state refers to a state in which the toe receiving member is allowed to rotate about a rotation point 170 with respect to the base 110 and the ski. The free rotation state may also be referred to as a climbing state, a free state, an uphill state, or a rotational state. By allowing the toe receiving member 140 to rotate with respect to the base 110, the boot is also allowed to freely rotate. It is desirable in many skiing activities to allow a boot to freely rotate with respect to the ski to allow for efficient snow travel and equipment longevity. By allowing the entire boot to rotate, the boot is able to remain substantially rigid thereby preserving its pivoting lifetime for the locked state only.

In many skiing activities it is necessary to ascend snow covered slopes. If a slope is not too steep, it is most efficient to skin up a slope using a pair of skins affixed to the bottom of the skis. Skinning up as slope includes alternately sliding each ski forward so as to cause an upward movement. It is necessary for both the front and rear boot to be able to articulate in some manner with respect to the ski. The more a boot is able to rotate with respect to the ski, the less energy is required to generate the forward movements. Therefore, uphill skinning is optimized in an operational state in which the boot is allowed to rotate free with respect to the ski about a rotation point 170. Free rotation includes minimizing biasing and frictional forces that would restrict a boot from rotating with respect to the ski. In addition, the rotation range is another factor in uphill skinning performance. For example, a binding that allows a boot to rotate 70 degrees will require more force to ascend a slope than a binding which allows a boot to rotate 90 degrees. Therefore, the rotation point 170 is positioned to maximize rotational freedom.

In operation, the free state is engaged by a series of interconnected operations. The specific interrelation of the various components is best illustrated in the cross-sectional view illustrated in FIG. 8. The free state is accomplished by selecting the free state on the switching mechanism via a downward pushing force in the illustrated embodiment. The switching mechanism is particularly configured to accept the downward force via a ski pole. The locked configuration corresponds to the toggle member 102 being rotated out away from the switch housing 104, as shown. The toggle member 102 is configured to frictionally engage the free state after receiving the pushing force. The free configuration of the switching mechanism increases tension and/or pulls the switch cable 106 coupled to the engagement mechanism 150. Since the latch 152 is spring biased into the engaged position, the increased tension of the switch cable 106 retracts the latch 152 away from the latch receiving member 158 located on the toe receiving member 140. The latch 152 is held away from the latch receiving member 158 by the latch cable 106. Therefore, if the latch cable 106 is severed or the operation of the switch is compromised, the latch 152 would rotate back into the engaged position causing the binding to assume the locked state. By ensuring that the locked state is the default state of the binding, an operational failure of the releasable system will not result in a complete binding failure.

FIGS. 3 and 6 illustrate the manner in which the toe receiving member 140 is able to rotate with respect to the base 110 in the free state. The toe receiving member 140 rotates about a rotation point 170 located under-boot from the toe receiving member 140. The rotation point 170 corresponds to the rotation axle 126 of the toe receiving member. Since the entire boot is allowed to rotate with respect to the base 100 and ski, the biasing system will not impose a biasing force that restricts the rotation in any way. The heel attachment system 160 will maintain the retention force on the boot while it rotates about the rotation point 170 such that the toe portion of the boot is engaged into the toe receiving member 140. The latch 152 is held out of the rotational path of the toe receiving member 140 such that there is no interference during rotation. The switching mechanism 120 is designed to maintain a low profile that will not interfere with the rotation of the boot and toe receiving member in the free state.

Thus, as discussed herein, the present invention relates to binding systems. In particular, the invention relates to multi-state binding systems. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A binding configured to releasably couple a boot to a ski comprising:

a toe receiving member configured to engage a toe portion of the boot;

a releasable system configured to couple the toe receiving member to the ski in at least two independent operational states, wherein a first state corresponds to a state in which the toe receiving member is free to rotate with respect to the ski, and wherein a second state corresponds to a state in which the toe receiving member is locked with respect to the ski, and wherein the releasable system further comprises:

a switching mechanism configured to transition the releasable mechanism between the first and second state; and an engagement mechanism configured to engage the toe receiving member in the second state, wherein the engagement mechanism is an under-boot rotational latching mechanism, and wherein the axis of rotation of the latching mechanism is substantially parallel to the ski.

2. The binding of claim 1 further includes a selectively engaged heel retention system to provide a third state in which both the toe receiving member and a heel portion of the boot are fixed with respect to the ski.

3. The binding of claim 1, wherein the releasable system further includes a rotation point about which the toe receiving member is able to rotate with respect to the ski in the first state.

4. The binding of claim 3, wherein the toe receiving member includes a pivot point about which a boot is able to pivot with respect to the ski in the second state, wherein the pivot point is disposed at least 30 mm away from the rotation point.

5. The binding of claim 1, wherein the toe receiving member includes a pivot point about which a boot is able to pivot with respect to the ski in the second state, wherein the pivot point is disposed at least 24 mm away from the front of the boot.

6. The binding of claim 1 further including a heel attachment system configured to couple between the toe receiving member and a heel portion of the boot, wherein the heel attachment system includes a replaceable pivot biasing system.

7. The binding of claim 1 further including a heel attachment system configured to couple between the toe receiving member and a heel portion of the boot, wherein the heel attachment system includes a heel throw and at least one under-boot cable.

8. The binding of claim 1, wherein the switching mechanism is configured to require a pushing force to transition between the first and second state and between the second and first state.

9. The binding of claim 1, wherein the engagement mechanism is spring-biased toward an engaged position.

10. The binding of claim 1, wherein the engagement mechanism is configured to automatically engage the second state if operation of the releasable mechanism is compromised in any manner.

11. A binding configured to releasably couple a boot to a ski comprising:

a toe receiving member configured to engage a toe portion of the boot;

a releasable system configured to couple the toe receiving member to the ski in at least two independent operational states, wherein a first state corresponds to a state in which the toe receiving member is free to rotate with respect to the ski, and wherein a second state corresponds to a state in which the toe receiving member is locked with respect to the ski, and wherein the releasable system further comprises:

a switching mechanism configured to transition the releasable mechanism between the first and second state; and an engagement mechanism configured to engage the toe receiving member in the second state, wherein the engagement mechanism is a spring-biased under-boot latching mechanism.

12. The binding of claim 11 further includes a selectively engaged heel retention system to provide a third state in which both the toe receiving member and a heel portion of the boot are fixed with respect to the ski.

13. The binding of claim 11, wherein the spring-biased latching mechanism is spring-biased toward an engaged position.

14. The binding of claim 11, wherein the toe receiving member includes a pivot point about which a boot is able to pivot with respect to the ski in the second state, wherein the pivot point is disposed at least 24 mm away from the front of the boot.

15. The binding of claim 11 further including a heel attachment system configured to couple between the toe receiving member and a heel portion of the boot, wherein the heel attachment system includes a replaceable pivot biasing system.

16. The binding of claim 11, wherein the switching mechanism is configured to require a pushing force to transition between the first and second state and between the second and first state.

17. The binding of claim 11, wherein the engagement mechanism is configured to automatically engage the second state if operation of the releasable mechanism is compromised in any manner.

18. A binding configured to releasably couple a boot to the ski comprising:

a toe receiving member configured to engage a toe portion of the boot;

a releasable system configured to couple the toe receiving member to the ski in at least two independent operational states, wherein a first state corresponds to a state in which the toe receiving member is free to rotate with respect to the ski, and wherein a second state corresponds to a state in which the toe receiving member is locked with respect to the ski, and wherein the releasable system further comprises:

a switching mechanism configured to transition the releasable mechanism between the first and second state; and an engagement mechanism configured to engage the toe receiving member in the second state, wherein the engagement mechanism is configured to automatically engage the second state if operation of the releasable mechanism is compromised in any manner.

19. The binding of claim 17, wherein the engagement mechanism is an under-boot rotatational latching mechanism, wherein the axis of rotation is substantially parallel to the ski.

20. A method for automatically engaging a locked state on a multiple operational state ski binding comprising the acts of:

providing a ski binding which releasably engages a toe portion of a boot to a ski in at least two independent operational states, wherein the binding includes a first state in which the boot is free to rotate with respect to the ski, and a second state in which a portion of the boot is substantially fixed with respect to the ski;

causing an operational failure of the ski binding in which the binding is no longer capable of switching between the independent operational states; and automatically engaging the second state of the ski system to substantially fix a portion of the boot with respect to the ski.

* * * * *